US005673806A

United States Patent [19]

Busnel

[11] Patent Number: 5,673,806

[45] Date of Patent: Oct. 7, 1997

[54] TEAT FOR A BABY'S BOTTLE, AND A BOTTLE FITTED WITH SUCH A TEAT

[76] Inventor: Marie-Claire Busnel, 3, Chemin de la Butte au Diable, 91570 Bievres, France

[21] Appl. No.: 630,768

[22] Filed: Apr. 10, 1996

[30] Foreign Application Priority Data

Apr. 10, 1995 [FR] France ..... 95 04249

[51] Int. Cl.[6] ..... A61J 11/04

[52] U.S. Cl. ..... 215/11.1; 222/490

[58] Field of Search ..... 215/11.1, 11.4; 606/236; 222/490, 494

[56] References Cited

U.S. PATENT DOCUMENTS

| | | | |
|---|---|---|---|
| 649,593 | 5/1900 | Black | 215/11.1 |
| 951,419 | 3/1910 | Eberley | 215/11.1 |
| 954,564 | 4/1910 | Dunfee | 215/11.1 |
| 1,099,082 | 6/1914 | Decker | 215/11.1 |
| 1,605,427 | 11/1926 | Delmas . | |
| 1,672,734 | 6/1928 | Reilly | 215/11.1 |
| 1,683,246 | 9/1928 | Griffiths . | |
| 1,733,184 | 10/1929 | Decker | 215/11.1 |
| 2,001,842 | 5/1935 | Heise et al. | 215/11.1 |
| 2,582,950 | 1/1952 | Alstadt et al. . | |
| 2,939,598 | 6/1960 | Donleavy | 215/11.1 |
| 3,112,837 | 12/1963 | Manoyian | 215/11.1 |
| 4,925,040 | 5/1990 | Wang | 215/388 |
| 5,282,541 | 2/1994 | Chen | 215/12.1 X |

*Primary Examiner*—Allan N. Shoap
*Assistant Examiner*—Christopher J. McDonald
*Attorney, Agent, or Firm*—Dickinson, Wright, Moon, Van Dusen & Freeman

[57] ABSTRACT

A teat for a baby's bottle, the teat comprising a body (3) that is generally hemispherical in shape and whose apex is extended axially by a projecting portion in the form of a nipple (5), the teat being characterized in that its nipple (5) is fitted with potentially dynamic means (10) designed to implement a spring effect firstly to enable axial stretching followed by a return to initial length, and secondly to reinforce stiffness so that radial compression is limited, thereby enabling suction to take place by pressure reduction only and not by squeezing.

12 Claims, 1 Drawing Sheet

TEAT FOR A BABY'S BOTTLE, AND A BOTTLE FITTED WITH SUCH A TEAT

FIELD OF THE INVENTION

The present invention relates to a teat for a baby's bottle, and to a bottle fitted with such a teat.

BACKGROUND

The shape of present-day teats and the material used for manufacturing them, generally an elastomer, are such that teats flatten easily, while being practically impossible to lengthen.

Specifically, once the teat has been inserted in the baby's mouth, the baby's tongue pushes it up towards the top of the palate to exert pressure thereon, causing the teat to be squeezed and a certain quantity of liquid to be ejected, which liquid is then swallowed by the baby.

That feeding mechanism has the following consequences in particular:

- simultaneous absorption of air which gives rise to burping and to gastrointestinal problems that are well known to pediatricians; and
- no stimulation of the distal portion of the soft palate, thus failing to establish the normal infantile swallowing action of a baby, and leading, on the contrary, to "adult" type swallowing which is considered as being atypical at that age.

In addition, it should also be observed that prolonged use of teats, and even more of comforters, can lead to permanent malformation of the jaws and the teeth of a baby which will subsequently be observed around age three or four by orthodontists, but which can only be treated properly between nine and twelve years of age. In some case, speech difficulties are observed by speech therapists due to a badly-positioned tongue associated with sucking a teat and to disharmonious development of the muscles around the mouth, which can sometimes lead to a long-lasting lisp. In recent years, the specialist literature in the above fields has confirmed those conclusions.

SUMMARY OF THE INVENTION

In general, the object of the invention is to mitigate the above-mentioned drawbacks and to design a teat which, unlike all teats presently on the market, takes into account scientific observations of effects made by orthodontists and speech therapists, and of causes made by dynamic examination of the mechanisms that apply while feeding is taking place at a woman's breast or nipple.

To this end, the invention provides a teat for a baby's bottle, the teat comprising a body that is generally hemispherical in shape and whose apex is extended axially by a projecting portion in the form of a nipple, the teat being characterized in that its nipple is fitted with potentially dynamic means designed to implement a spring effect firstly to enable axial stretching followed by a return to initial length, and secondly to reinforce stiffness so that radial compression is limited, thereby enabling suction to take place by pressure reduction only and not by squeezing.

Thus, such a teat is designed to implement a natural sucking mechanism by pressure reduction corresponding to the mechanism used for feeding from the mother's breast. Under such conditions, the baby can control the quantity of milk ingested on each suck, and can also control the rate of sucking, with such ingestion being accompanied by a minimum amount of air being swallowed, thus leading to better digestion.

It has been shown that the tongue of a baby wraps around a nipple, and that a nipple does not flatten on being squeezed, with this being accompanied by a backwards sucking movement, thereby stretching the mother's organ which doubles in length. When muscularly stimulated in this way, the breast ejects its milk into the back of the baby's throat. That is where the tip of the nipple makes contact with the reflex zone situated in the soft palate. When stimulated by the combined pressure from milk and from the mother's organ, this zone triggers the "infantile" swallowing mechanism which then takes place with practically no associated intake of air.

In general, the shape and dimensions of the nipple of the teat when at rest are the same as those of the nipple of a mother's breast.

In one embodiment, the means incorporated in the nipple of the teat to enable it to stretch axially and to return to its initial position are constituted by semi-rigid reinforcement acting like a stretchable spring, in the form of a helical spring and made of rubber, for example.

In general, the nipple of the teat is defined by an envelope whose overall shape is generally tubular and closed at one end embodying the tip thereof, with the reinforcement being embedded in the envelope.

The open end of the teat body is fitted with means enabling it to be assembled on the body of a baby's bottle in leakproof and releasable manner.

In one embodiment of the invention, the teat body is surrounded by a spherical cap simulating the mother's breast and pierced by a central opening through which the teat passes freely, the spherical cap being designed to be assembled to the body of the baby's bottle by screw engagement, for example.

The spherical cap may advantageously be covered in a layer of elastomer to simulate the feel of human skin, and the mother can wipe said layer over her own breast to impregnate it with her own odor.

In a variant embodiment of the invention, the spherical cap constitutes the body of the teat and may also constitute the top portion of the body of the baby's bottle.

The invention also provides a baby's bottle of a shape adapted to the shape of a teat having the above-specified characteristics.

According to an important advantage of the invention, the nipple of the teat serves to stimulate the baby's natural sucking mechanism, i.e. it enables the baby's tongue to wrap around the teat and it facilitates touching of the soft palate situated behind and in line with the baby's hard palate, because the teat is capable of being stretched.

BRIEF DESCRIPTION OF THE DRAWINGS

Other advantages, characteristics, and details of the invention appear from the following explanatory description made with reference to the accompanying drawings, that are given purely by way of example, and in which.

DESCRIPTION OF EMBODIMENT OF THE INVENTION

Figure 1:
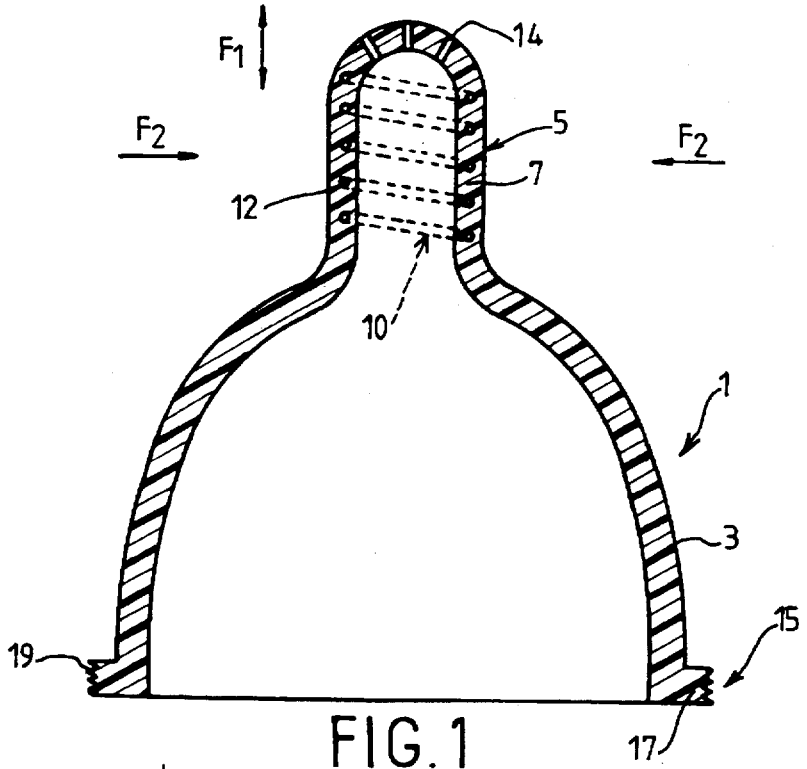
FIG. 1 is an axial section view on an enlarged scale of a teat of the invention.

The teat 1 of the invention and as shown in FIG. 1 is constituted by a hemispherical body 3 whose apex is extended axially by a projecting portion in the form of a nipple 5. The shape and the dimensions given to the nipple 5 are defined so that they correspond overall to the shape and dimensions of the nipple of a mother's breast so as to stimulate the natural sucking mechanism of the baby in a manner analogous to that which takes place during breast-feeding.

By way of example, the nipple 5 may have an axial length of about 10 mm to 15 mm and a diameter of about 10 mm to 12 mm, and it is capable of being stretched axially by a factor of at least 2.

The nipple 5 is defined by a generally tubular envelope 7 whose closed end forms a nipple tip and whose opposite end is open and extends the apex of the body 3 of the teat 1.

According to the invention, the nipple 5 of the teat 1 includes means 10 whose purpose is to enable the nipple 5 to be stretched or lengthened axially and to be retracted axially in the direction of arrow F1, and also to stiffen the envelope 7 so as to restrict the amount whereby it can be compressed radially in the direction of arrows F2.

These means 10 are constituted by semi-rigid reinforcement 12 embedded in the envelope 7 of the nipple 5. The reinforcement 12 is designed to act like a spring so as to enable the nipple 5 to stretch to about twice its length when a suction force of only a few grams is applied thereto, and then to return to its initial position.

By way of example, the reinforcement 12 is constituted by a helically-shaped spring whose diameter corresponds to the mean diameter of the envelope 7 of the nipple 5. By way of example, the reinforcement 12 may be made of vulcanized rubber, of a plastics material, or of a metal.

The tip of the nipple 5 has a plurality of holes 14 which may be pierced by means of a laser beam, for example, with the number and size of the holes 14 being variable as a function of the age and sucking power of the baby.

Coupling means 15 are provided at the bottom portion of the body 3 of the teat 1 to enable it to be assembled in leakproof and releasable manner to the body of the bottle.

To this end, the bottom portion of the body 3 of the teat 1 has a radially outwardly-directed flange 17 whose peripheral surface includes a thread 19 designed to co-operate with a complementary thread provided around an orifice of the bottle, as explained below.

In general, the nipple 5 and the body 3 of the teat 1 form a single part that is made out of an elastomer material, such as natural latex, or a synthetic elastomer such as a silicone, for example.

Figure 2:
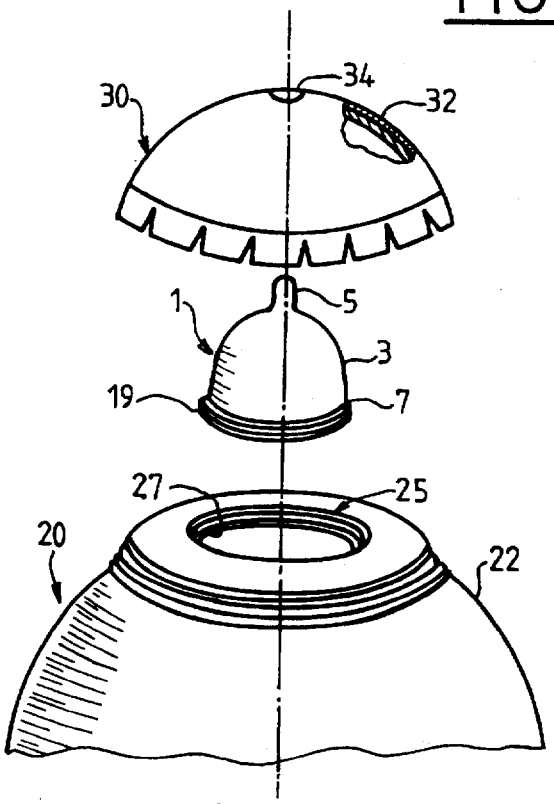
FIG. 2 is a fragmentary exploded perspective view of a teat and a baby's bottle to show one way of assembling the teat on the body of the bottle.

A bottle 20 adapted to receive the above-described teat 1 is shown diagrammatically in FIG. 2. The bottle comprises a body 22 of which only a portion of its top end is shown. The body 22 may be made up of top and bottom portions which are assembled together by appropriate means (not shown).

The apex of the body 22 includes a central opening 25 whose outline includes a thread 27 that is complementary in shape to the thread 19 so as to enable the body 3 of the teat 1 to be screwed therein.

Provision is also made for fitting a spherical cap 30 around the teat 1 to simulate the mother's breast. The cap 30 is broad, being hemispherical in shape and made, for example, out of an elastomer material. Advantageously, a satiny layer 32 such as a silicone foam, for example, is deposited on the cap 30 so as to give the baby a tactile sensation of the same type as that given by the mother's breast.

The apex of the cap 30 is pierced by a central opening 34 of the same dimensions as the nipple 5 so as to allow the nipple to pass freely therethrough. The cap 30 can thus cover the body 3 of the teat 1, and it may be held on the body 22 of the bottle 20 by screw engagement. To this end, the top portion of the body 22 includes an annular projection 36 whose outer periphery has a thread 38 designed to co-operate with a complementary thread (not shown) provided on the inside wall of the cap 30, at the bottom portion thereof.

Figure 3:
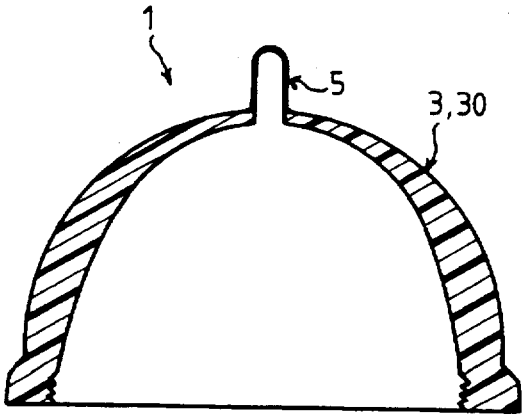
FIG. 3 is an axial section view through a variant embodiment of the teat of the invention.

In a variant embodiment shown in FIG. 3, the above-mentioned cap 30 constitutes the body 3 of the teat 1 and its central opening 34 is then extended by a nipple 5 similar to that shown in FIG. 1.

The cap 30 may then advantageously form the top portion of the body 22 of the bottle 20, as shown in FIG. 2.

Naturally, the invention is not limited to the embodiments described above. In particular, variants may be envisaged relating to the means for couping together the teat 1 and the top portion of the body 22 of the bottle 20.

I claim:

1. A teat for a baby's bottle, the teat comprising a body portion that is generally hemispherical in shape and an apex extending axially comprising an axially flexible projecting portion in the form of a nipple, wherein said nipple further comprises semi-rigid reinforcement means embedded in said nipple for enabling axial stretching followed by a return to initial length, and reinforcing stiffness so that radial compression is limited.

2. A teat according to claim 1, wherein the shape and size of its nipple (5) are the same as those of the nipple of a mother's breast.

3. A teat according to claim 1, wherein said reinforcement (12) is constituted by a stretchable spring that is helical in shape.

4. A teat according to claim 1, wherein the reinforcement (12) is made of elastomer or of metal.

5. A teat according to claim 1, wherein an open end of the body portion (3) of the teat (1) is fitted with means (15) enabling the body portion (3) of the teat (1) to be assembled to a bottle (20) in releasable and leakproof manner.

6. A teat according to claim 1, wherein its body portion (3) and its nipple (5) constitute a single part manufactured out of an elastomer material such as natural latex, or a synthetic elastomer such as silicone.

7. A teat according to claim 1, wherein the body portion (3) of the teat (1) is surrounded by a broad cap (30) of hemispherical shape to simulate the mother's breast, said cap (30) being pierced by a central opening (34) to allow the nipple (5) of the teat to pass through and also being designed to be assembled on a baby's bottle.

8. A teat according to claim 7, wherein the cap (30) is made of elastomer material and is assembled on the bottle (20) in removeable manner by screw engagement.

9. A teat according to claim 7, wherein the cap (30) is covered in a layer (32) of an elastomer.

10. A teat according to claim 8, wherein the cap (30) and the body portion (3) of the teat constitute a single part.

11. A teat according to claim 10, wherein the cap (30) also forms the top portion of the bottle (20).

12. A nipple for a baby bottle comprising:

a flexible tubular envelope having a substantially closed end defining a tip and an open end with means for engaging said bottle; and means embedded in said nipple enabling axial stretching followed by a return to initial length, and reinforcing stiffness so that radial compression is limited.

* * * * *